US005771541A

United States Patent [19]

Sterin et al.

[11] Patent Number: 5,771,541

[45] Date of Patent: Jun. 30, 1998

[54] APPARATUS FOR CLEANING FIBERS

[75] Inventors: Shlomo Sterin; Moshe Kokish, both of Jerusalem, Israel

[73] Assignee: MTM—Modern Textile Machines Ltd., Jerusalem, Israel

[21] Appl. No.: 829,181

[22] Filed: Mar. 31, 1997

Related U.S. Application Data

[63] Continuation-in-part of Ser. No. 553,054, Nov. 3, 1995, Pat. No. 5,655,262.

[30] Foreign Application Priority Data

Nov. 3, 1994 [IL] Israel ..... 111520
Feb. 26, 1995 [IL] Israel ..... 112791

[51] Int. Cl.[6] ..... D01B 5/08

[52] U.S. Cl. ..... 19/200; 19/99

[58] Field of Search ..... 19/200, 202, 203, 19/204, 205, 106 R, 112, 114, 113, 98, 99, 100, 101, 104, 108, 110

[56] References Cited

U.S. PATENT DOCUMENTS

| | | | |
|---|---|---|---|
| 2,788,547 | 4/1957 | Kaufman et al. | 19/98 |
| 2,835,929 | 5/1958 | Taine et al. | 19/99 |
| 2,923,980 | 2/1960 | Steinruck | 19/99 |
| 3,051,996 | 9/1962 | Varga | 19/99 |
| 4,090,276 | 5/1978 | Roberts | 19/99 |
| 4,115,903 | 9/1978 | Barber | 19/99 |
| 4,128,917 | 12/1978 | Varga | 19/98 |
| 4,129,924 | 12/1978 | Wirth | 19/99 |
| 4,219,908 | 9/1980 | Winch et al. | 19/99 |
| 4,523,350 | 6/1985 | Schmiedgen et al. | 19/98 |
| 4,642,850 | 2/1987 | Giuliani | 19/99 |
| 4,712,216 | 12/1987 | Krusche | 19/99 |
| 4,852,217 | 8/1989 | Bernhardt et al. | 19/98 |
| 4,858,276 | 8/1989 | Frosch et al. | 19/98 |
| 4,958,404 | 9/1990 | Lasenga | 19/98 |
| 5,146,652 | 9/1992 | Leifeld | 19/200 |
| 5,522,119 | 6/1996 | Leifeld et al. | 19/98 |

*Primary Examiner*—Michael A. Neas
*Attorney, Agent, or Firm*—Browdy and Neimark

[57] ABSTRACT

The invention provides an apparatus for cleaning fibers by means of revolving rollers, the fiber mass being divided, expanded, and recombined while being successively transferred over at least three rollers, the outer surface of at least one of the rollers revolving in close proximity to, but spaced apart from, the other rollers, to form a substantially triangular enclosure therebetween, the apparatus including a first roller, driven at peripheral speed faster than the remaining rollers, arranged as a moving source of fiber supply at the beginning of the process and to receive and card fibers from the third of the rollers; a second, condenser roller, driven at a peripheral speed slower than the first roller, arranged to receive at least a part of the fiber mass from the first roller and to transport the fibers to the third roller; a third, opening roller, driven at a peripheral speed relatively slower than the first roller, arranged to receive fibers from the condenser roller and to transport the fibers back to the first roller; and a stationary fiber stream separator body positioned within the triangular enclosure, the body being of substantially triangular cross-section, for directing fiber streams and preventing turbulent interaction between the streams within the substantially triangular enclosure.

28 Claims, 3 Drawing Sheets

FIG. 1
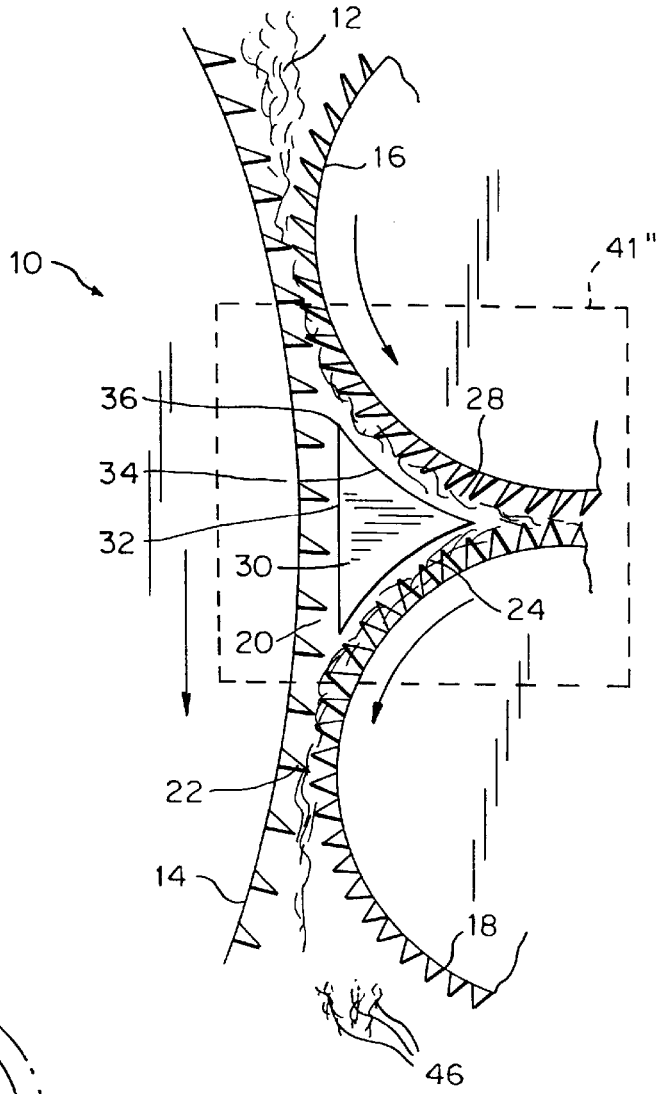
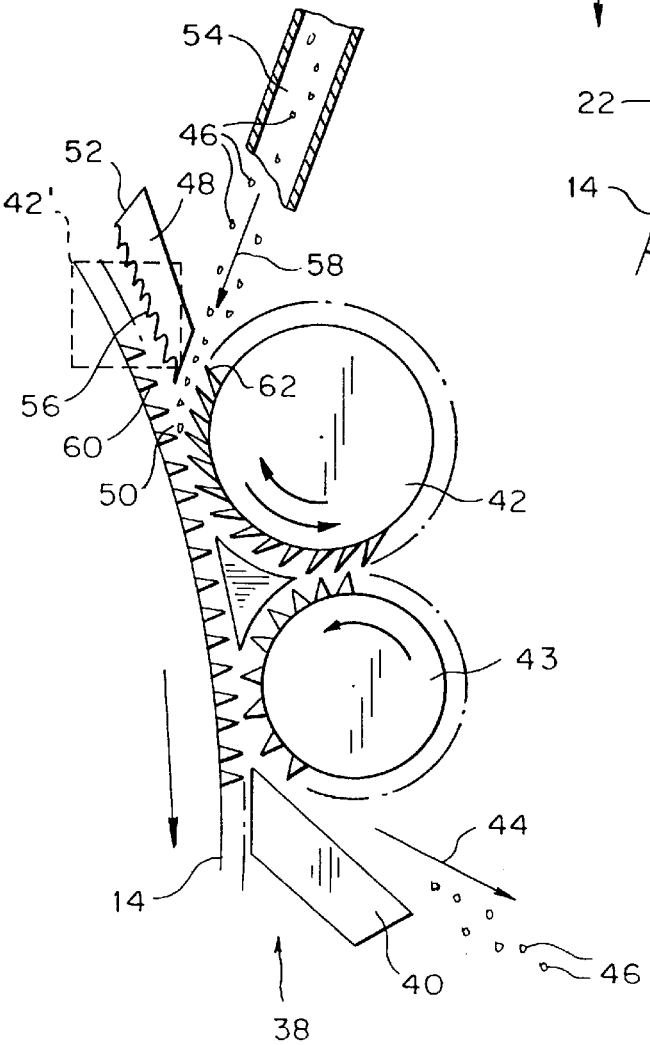
FIG. 2

APPARATUS FOR CLEANING FIBERS

The present specification is a continuation-in-part of U.S. patent application Ser. No. 08/553,054, filed Nov. 3, 1995, now U.S. Pat. No. 5,655,262.

BACKGROUND OF THE INVENTION

1. Technical Field of the Invention

The present invention relates to an apparatus for cleaning fibers by removing waste particles therefrom. More particularly, the present invention relates to an apparatus for cleaning cotton or wool fibers while carrying out a plurality of textile fiber processes, typically carding and stripping.

2. Prior Art

As described in the literature, e.g., in *Manual of Cotton Spinning*. Textile Institute and Butterworth & Co. Ltd. (1965), after the opening of a bale of fibers, one of the first stages of processing is performed with a carding machine. Carding is defined as the reduction of an entangled mass of fibers to a filmy web by working the fibers between two closely spaced, relatively moving surfaces covered with sharp points.

As stated in said Manual, baled cotton contains a small percentage of trash, i.e. particles of leaf, seed, seed coat and stalk from the cotton plants, and also sand and soil from the ground in which the plants were grown. About 70–80% of this trash falls away when the bale is opened. The remainder is imprisoned in the tufts of cotton, and some of it is firmly attached to the fibers themselves. It is a function of the carding process to remove as much trash as possible from the cotton. The fine action of the carding breaks up the tufts, and thereby releases some of the trash for rejection. The wire surfaces of the carding machine retain a portion of the residue, so that after carding a portion of the original trash, depending on the trash type and on the carding action, is left in the sliver.

During processing, cotton is fed to the doffer of a carding machine; some trash is still present in the cotton at this stage. It is obvious that high quality textiles cannot be produced unless such particles are removed. Furthermore, such particles, if not removed, are likely to damage or erode operating components of the spinning and other machinery used for further processing, or to cause stoppages due to thread breakage.

Traditional combing machines arranged to effect separation of trash particles from the fibers are complicated and do not have high throughput rates. Furthermore, such machines tend to damage the fibers, with the consequent inclusion of an undesirably high percentage of short fibers in the material being processed. Short fibers are detrimental to the spinning process and reduce the tensile strength of the produced thread.

Prior art carding devices are based on flat or cylindrical surfaces which are covered with a large number of single-function teeth. The relative movement of two such surfaces produces a carding action. Thereafter, a stripping action is necessary, wherein the fibers are removed from the carding surfaces and transferred to further processing. This stripping action, as such, makes no contribution to the processing of the fibers.

OBJECT AND SUMMARY OF THE INVENTION

It is one of the objects of the present invention to obviate the disadvantages of the prior art devices for separating trash particles from textile fibers and to provide an apparatus which is operable at a high throughput rate.

It is a further object of the invention to provide means for effecting carding while causing less damage to fibers than the prior art arrangements.

It is a still further object of the present invention to remove trash particles from textile fibers, while preventing damage or length reduction to the fibers being processed.

The present invention achieves the above objectives by providing an apparatus for cleaning fibers by means of a combination of revolving rollers, the fiber mass being divided, expanded, and recombined while being successively transferred over at least three rollers; the outer surface of at least one of said rollers revolving in close proximity to, but spaced apart from, the other rollers, to form a substantially triangular enclosure therebetween, said apparatus comprising a first roller, driven at a peripheral speed faster than said remaining rollers, and arranged as a moving source of fiber supply at the beginning of the process, and to receive carded fibers from the third of said rollers at the end of said process; a second, condenser roller, driven at a peripheral speed slower than said first roller, arranged to receive at least a part of said fiber mass from said first roller and to transport said fibers to said third roller; a third, opening roller, driven at a peripheral speed relatively slower than said first roller, arranged to receive fibers from said condenser roller and to transport said fibers back to said first roller; and a stationary fiber stream separator body positioned within said triangular enclosure, said body being of substantially triangular cross-section, for directing fiber streams and preventing turbulent interaction between said streams within said substantially triangular enclosure.

In a preferred embodiment of the present invention, there is provided an apparatus for cleaning fibers wherein a separating blade is held under and in proximity to at least one of said rollers, whereby heavy waste particles impinge on said blade and are separated from said fibers by gravity, centrifugal force and aerodynamic forces.

It will thus be realized that the novel fiber-waste separator apparatus of the present invention divides and expands the fiber mass to ease the removal of waste particles embedded therein.

The various separation modes provided by the invention take into account the fact that not all waste particles are alike. For example, separation by centrifugal force is most effective for high-density particles, such as those of metal; separation by air stream is effective for low-density particles; and crushing and pulverizing are suitable for hard, brittle waste such as soil.

The high output rates and simplicity of the mechanism are made possible by the use of revolving rollers and the avoidance of reciprocating components.

As is known in the art, fundamentally there are two important actions performed by carding surfaces: carding and stripping. The action which takes place between two carding surfaces depends upon both the inclination of the wires and/or teeth and the direction and rate of their motion in relation to each other.

Carding action is accomplished when the wires or teeth of the two surfaces are inclined in opposite directions. The direction and rates of motion should be such that one surface passes the other point-to-point. This action may be accomplished by both surfaces traveling in the same direction, with the lower surface moving rapidly past the upper surface; or the action may be obtained by having the surfaces move in opposite directions, each in the direction of inclination of the wires or teeth. Carding action results in complete opening of the tufts of the lap.

Stripping action is accomplished when the wires or teeth of two surfaces point in the same direction. In such an arrangement, the surfaces pass each other point against smooth side. The surface which moves the faster lifts the cotton away from the other wire or tooth and collects it. Stripping is used in transferring cotton from one surface to another and in removing it from a surface.

U.S. Pat. No. 4,090,276 states (lines 40–45) that in the apparatus claimed therein, the angle of the effective working faces of the various wire teeth, relative to the surface of the foundation, is preferably within 30°–90°. The present inventor believes that such small angles cannot be used, due to their causing fiber overlapping and fiber rupture. Furthermore, the cylinder teeth would be unable to strip fibers from the roller. According to tests carried out by the present inventor, for successful operation the tooth angle must be increased to within the range of 90°–120°.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only. They are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

BRIEF DESCRIPTION OF THE DRAWINGS

FIG. 1 is a schematic view of a preferred embodiment of the apparatus according to the invention;

FIG. 2 is a schematic view of part of another embodiment of the apparatus, further provided with a separator plate;

DETAILED DESCRIPTION OF THE PREFERRED EMBODIMENT(S) OF THE INVENTION

Figure 3:
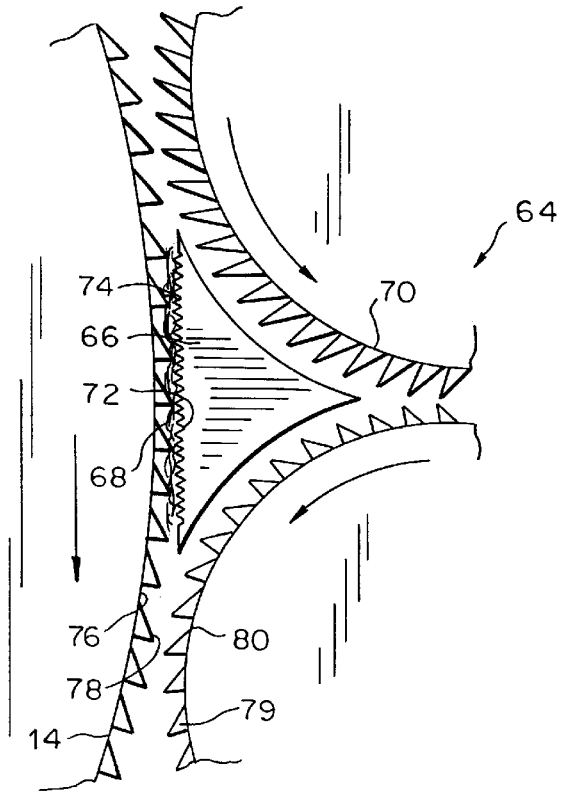
FIG. 3 is a schematic view of the detail of an apparatus similar to that shown in FIG. 1, but wherein the fiber separator body has a toothed surface.

There is seen in FIG. 1 an apparatus 10 for cleaning fibers by means of revolving rollers, the incoming fiber mass 12 being divided, expanded, and recombined while being successively transferred over three toothed rollers 14, 16, 18. The outer surfaces of the rollers are arranged to revolve in close proximity to, but spaced apart from, each other, thus forming a substantially triangular enclosure 20 between them.

A large diameter, first roller or cylinder 14 is arranged to be driven at a peripheral speed faster than that of the remaining rollers 16, 18. First roller 14 is driven in the direction of the arrow at about 500–4,000 m/min and holds fibers on its teeth 22. First roller 14 is preferably arranged as a cylinder of a card machine, arranged as a moving source of fiber supply at the beginning of the process. It again receives the now cleaned and partially carded fibers 24 from the third, opening roller 18, at the end of the process. Advantageously, opening roller 18 is provided with neutral take-off-like teeth 26. The peripheral velocity of opening roller 18 is 20–1500 m/min. The transfer of fibers between rollers is further explained below with reference to FIG. 3.

The second, condenser roller 16 is arranged to be driven at a peripheral velocity slower than that of the first roller, typically also at a velocity of 20–1500 m/min. Condenser roller 16 is arranged to receive at least a portion 28 of fiber mass 12 from first roller 14 and to card the fibers while transporting the fibers 28 to opening roller 18. In the preferred embodiment shown, the second and third rollers 16, 18 rotate in the same direction as each other, here shown anti-clockwise, while the first roller 14 rotates in the opposite, clockwise direction.

Waste particles 46, naps and short fibers are ejected from all three rollers 14, 16, 18, due to centrifugal force.

A stationary, fiber stream separator body 30 is positioned within the triangular enclosure 20 formed between the three rollers. Body 30 is substantially a prism of triangular cross-section. The first function of body 30 is to direct fiber streams, that is, to assist in separating fibers from first roller 14, thereby reducing the percentage of fibers which remain on the first roller 14 and are cleaned to a lesser degree. Secondly, body 30 prevents the turbulent interaction of air and fibers within triangular enclosure 20, thus reducing fiber entanglement and fiber damage. Preferably, body 30 is located at a distance of 0.1–1.5 mm from first roller 14; 1–10 mm from condenser roller 16 and 0.1–6 mm from opening roller 18. It is preferable that these distances be adjustable, by adjusting means 41', which are conventional and therefore shown only schematically on FIG. 1 so that the apparatus may be adapted to suit varying conditions which may be met during operation of apparatus 10.

Advantageously, the separator body 30 is adjustable by means 41' in a manner allowing tilting of the body 30 to be nearer any of the rollers, e.g., nearer the first roller 14 at one of its ends and further therefrom at its other end. Under some operating conditions, good results are obtained when body 30 is so tilted. Under all conditions, good results are obtained when at least two sides 32, 34 of separator body 30 come together to form a pointed edge 36. Alternatively, said body can be interchangeable with a different body (not shown) arranged so that the distance between an edge of a side surface of said body and a roller adjacent thereto, and the distance between an opposite edge of said body and said same roller, are unequal. A further desirable feature is that the body 30 has concave sides, which are complimentary to the convex surfaces of the adjacent rollers.

With regard to the rest of the drawings, similar numerals have been used to designate similar parts.

Referring now to FIG. 2, there is shown an apparatus 38 similar to that seen in FIG. 1, but having additional features. A separator blade 40 is held in proximity to the first and third rollers 14, 43, for separating waste particles from fibers. All three rollers 14, 42, 43 have teeth, but these are shown only partly in the simplified illustration. Suction means 44 are applied in the area between third roller 43 and separator blade 40, for drawing off waste particles 46, neps and short fibers. A cover plate 48 is positioned in spaced-apart relationship to a surface area of first roller 14, before the juncture of first and second rollers 14, 42, for directing fibers along the surface of first roller 14. In operation, the good fibers 50 pass underneath the cover plate 48, but waste particles 46, naps and very short fibers are ejected due to aerodynamic effects toward a conduit 54, from whence they are transferred to a collection container (not shown).

Advantageously, the distance between first roller 14 and plate 48 is as small as 0.2–0.5 mm. However, when coarse preliminary cleaning is carried out, the distance is increased up to 2.5 mm. In any case, means 42', which are conventional and shown schematically on FIG. 2, make the distance adjustable, whereby changes can be effected as necessary in the airflow and the flow of entrained fibers.

A further feature of the embodiment of FIG. 2 is that the inside surface of plate 48 is provided with teeth 56 for fiber carding. Suction means 58 is also used in the area between first roller 14, plate 48, and second roller 42 for drawing off waste particles 46, naps and short fibers.

In the present embodiment, the direction of teeth 60, 62 between the first and second rollers 14, 42 is point-to-point. Such a configuration has been found to operate well in carding and cleaning cotton fibers.

FIG. 3 depicts an apparatus 64 wherein some additional carding is effected by the separator body 66, for the minority of fibers 68 still remaining on the first roller 14 after most of the fibers have been removed by second roller 70. One side 72 of fiber stream separator body 66 is provided with teeth 74 for fiber carding. Each tooth 74 lifts the fibers 68 on first roller 14 from the tooth base 76 towards the tooth crest 78. Such raised fibers 68 interact favorably with a separator blade 40, of the type described above with reference to FIG. 2.

In the present embodiment 64, the tooth form 79, which acts as a carding wire on third roller 80, is substantially identical in configuration to the tooth form of first roller 14, which acts as the complementary carding wire. As shown, the direction of teeth between the first and third rollers 14, 80 is point-to-back. Stripping action is thereby accomplished, as the teeth of these rollers point in the same direction. The roller 14, moving faster than roller 80, lifts the cotton fibers away from roller 80.

In exactly the same manner, the direction of teeth between second and third rollers 70, 80 is point-to-back. Here also, stripping action is accomplished, as the teeth of these rollers point in the same direction.

Figure 4:
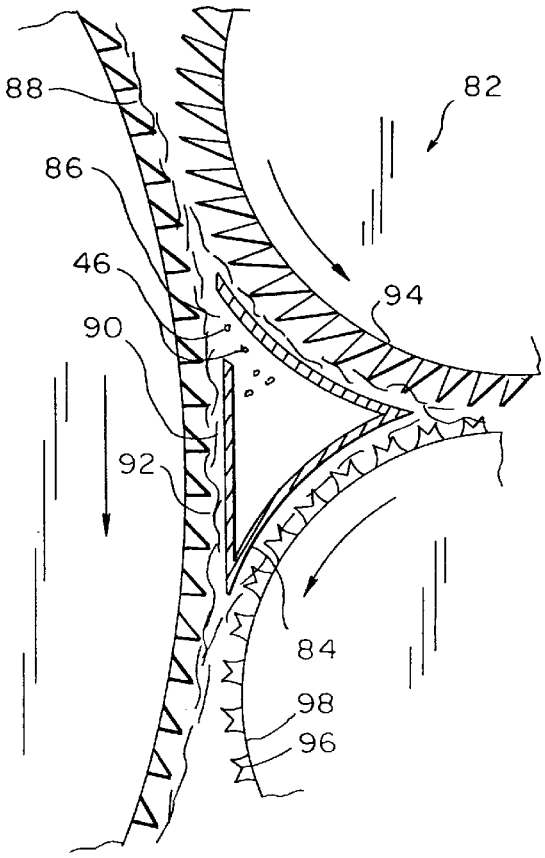
FIG. 4 is a schematic view of an embodiment wherein the separator triangle is used for suction application.

FIG. 4 shows an apparatus 82 wherein a triangular-section separator body 84 is used for the application of suction. The body 84 is provided with an opening 86, for separating and collecting dust and waste particles 46 from fibers 88 entering the triangular enclosure 90. Suction applied to body 84 tends to draw in very short fibers and light-density trash, but normal fibers 92 remain on the first roller 14, except for those fibers which have previously been removed by the second roller 94.

In the present embodiment, the teeth 96 of the third roller 98 have a dual function. The effect of this tooth form is to reap the benefits both of teeth which point in the direction of roller rotation, as well as of those pointing in the opposite direction.

Figure 5:
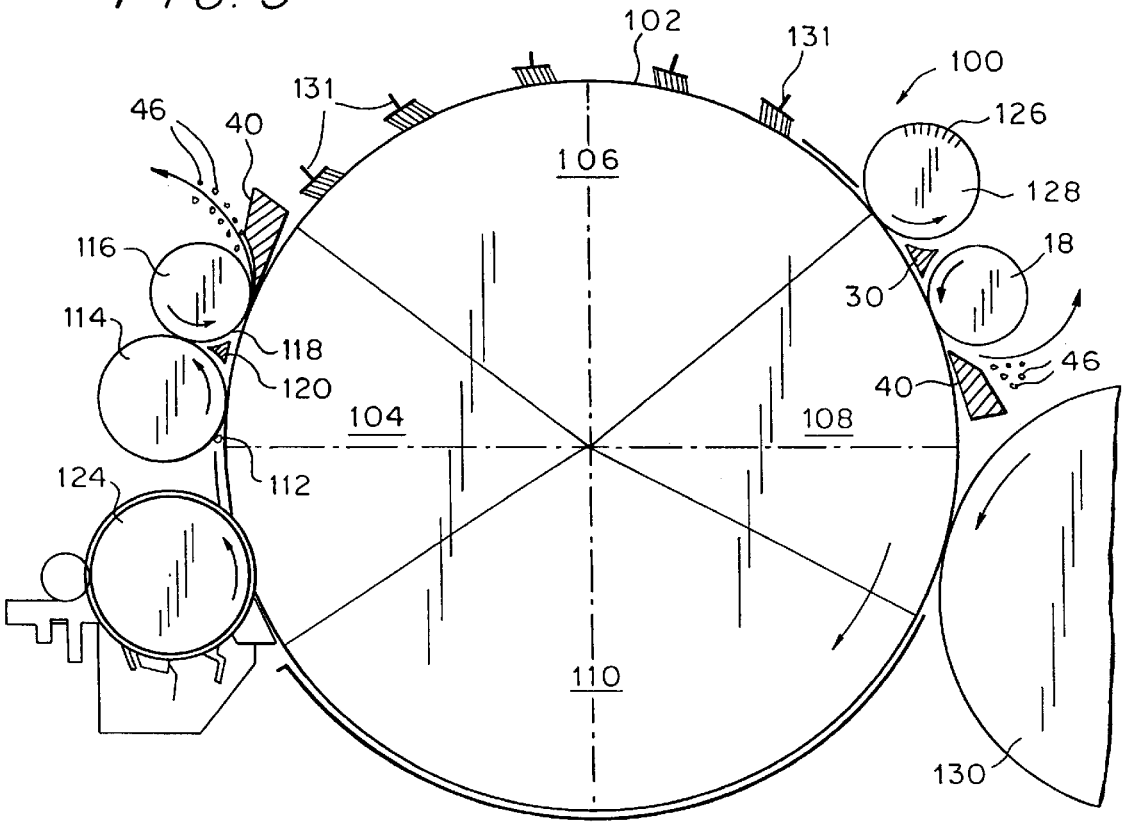
FIG. 5 is a schematic view of an embodiment wherein the carding cylinder has four functional zones, including pre-carding and post carding.

Shown in FIG. 5 is an embodiment of the apparatus 100 wherein the first roller 102 has four functional zones: a pre-carding zone 104, a main carding zone 106, a post-carding zone 108 and an under-carding zone 110. Coarse cleaning is carried out in the pre-carding zone 104. Also effected in zone 104 is the carding of large tangled fiber bundles 112. In the post-carding zone 108, the normal fibers are separated from small waste particles 46, naps, and very short fibers.

An additional condenser roller 114 and a further opening roller 116 operate in the pre-carding zone 104, in combination with first roller 102. The outer surface of roller 102 revolves in close proximity to, but spaced apart from, rollers 114, 116, thus forming a further triangular enclosure 118 therebetween. A second stationary fiber stream separator body 120 is positioned within enclosure 118, functioning in exactly the same manner as was explained above with reference to body 30. A lickerin roller 124 is positioned adjacent to pre-carding zone 104.

The teeth 126 of second roller 128 are shaped as wire from a conventional carding surface, and are substantially identical in configuration to the card wire of a doffer 130. A plurality of carding brushes 131 is rigidly supported above the main carding zone 106.

In the present embodiment, the further opening roller 116 rotates in the same direction as first roller 102.

Figure 6:
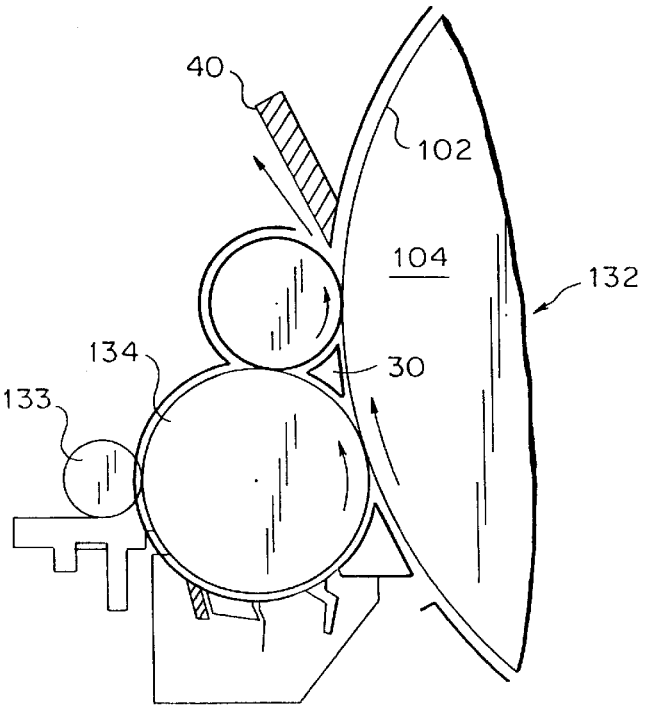
FIG. 6 is a schematic view of an embodiment of a carding machine receiving a second supply of fibers.

Seen in FIG. 6 is an embodiment of a wool carding machine 132, receiving a second supply of fibers from a further roller 133. The present embodiment is similar to the embodiment of FIG. 1, except that the further supply roller 133 is arranged as a second moving supply source of fibers to condenser roller 134. The additional fibers from said further fiber supply source are introduced directly onto roller 134, as are the fibers from first roller 104. The apparatus of this embodiment thus provides a larger throughput, without any substantial increase in floor space requirements. The apparatus of FIG. 6 is also provided with a separator blade 40, as described above with reference to FIG. 2.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. An apparatus for cleaning fibers by means of revolving rollers, the fiber mass being divided, expanded, and recombined while being successively transferred over at least three rollers, the outer surface of at least one of said at least three rollers revolving in close proximity to, but spaced apart from remaining rollers of said at least three rollers, to form a substantially triangular enclosure therebetween, said apparatus comprising:

a first roller of said at least three rollers, driven at peripheral speed faster than said remaining rollers, arranged as a moving source of fiber supply at the beginning of the process and to receive and card fibers from one of said remaining rollers;

a second, condenser roller of said at least three rollers, driven at a peripheral speed slower than said first roller, arranged to receive at least a part of said fiber mass from said first roller and to transport said fibers to one of said remaining rollers;

a third, opening roller of said at least three rollers, driven at a peripheral speed relatively slower than said first roller, arranged to receive fibers from said second condenser roller and to transport said fibers back to said first roller; and a stationary fiber stream separator body positioned within said triangular enclosure, said body being of substantially triangular cross-section, for directing fiber streams and preventing turbulent interaction between said streams within said substantially triangular enclosure.

2. The apparatus according to claim 1, wherein said first roller is arranged as a cylinder of a carding machine.

3. The apparatus according to claim 1, further comprising at least one separator blade held in proximity to one of said at least three rollers, for separating waste particles from said fibers.

4. The apparatus according to claim 3, wherein said separator blade is positioned in proximity to said first roller and said third roller.

5. The apparatus according to claim 4, wherein suction means are applied in the area between said third roller and said separator blade, for drawing off waste particles, naps and short fibers.

6. The apparatus according to claim 1, wherein said fiber stream separator body is at a distance of 0.1–1.5 mm from said first roller, 1–10 mm from said second, condenser roller and 0.1–6 mm from said third, opening roller.

7. The apparatus according to claim 6, having means for adjusting said distances.

8. The apparatus according to claim 1, wherein at least two sides of said fiber stream separator body come together to form a pointed edge.

9. The apparatus according to claim 1, wherein said fiber stream separator body has concave sides, complimentary to the convex surfaces of the adjacent at least three rollers.

10. The apparatus according to claim 1, wherein at least one side of said fiber stream separator surface is provided with teeth for fiber carding.

11. The apparatus according to claim 1, wherein said triangular body is provided with an opening for separating and collecting dust and waste particles from the fibers entering said triangular enclosure.

12. The apparatus according to claim 1, wherein said second roller and said third roller rotate in the same direction, and said first roller rotates in the opposite direction.

13. The apparatus according to claim 1, further comprising a cover plate positioned in spaced-apart relationship to a surface area of said first roller before the juncture of said first roller and said second roller, for directing fibers and air streams along the surface of said first roller.

14. The apparatus according to claim 13, having means for adjusting the distance between said first roller and said cover plate is adjustable, for changing the direction of the streams of air and fibers.

15. The apparatus according to claim 13, wherein an inside surface of said cover plate is provided with teeth for fiber carding.

16. The apparatus according to claim 1, wherein suction means are applied in an area between said first roller, said cover plate and said second roller, for drawing off waste particles, naps and short fibers.

17. The apparatus according to claim 1, wherein the direction of teeth between said first and second rollers is point-to-point.

18. The apparatus according to claim 1, wherein the direction of teeth between said first and third rollers is point-to-back.

19. The apparatus according to claim 1, wherein the direction of teeth between said second roller and said third roller is point-to-back.

20. The apparatus according to claim 19, wherein the teeth of said third roller are dual-functional teeth.

21. The apparatus according to claim 1, wherein said third roller is provided with card wires substantially identical in configuration to card wires of said first roller.

22. The apparatus according to claim 1, wherein said third roller is provided with neutral, take-off-like teeth.

23. The apparatus according to claim 1, wherein said second roller is provided with card wires substantially identical in configuration to card wires of a doffer of a carding machine.

24. The apparatus according to claim 1, comprising a further condenser roller and a further opening roller in combination with said first roller, wherein the outer surface of at least one of said rollers revolves in close proximity to, but spaced apart from, said two other rollers to form a further triangular enclosure therebetween, a stationary fiber stream separator body being positioned within said further triangular enclosure, said body being substantially triangular, for directing fiber streams and preventing turbulent interaction therebetween within said triangular enclosure.

25. The apparatus according to claim 1, comprising a further roller arranged as a second moving supply source of fibers, wherein additional fibers from a further fiber supply source are introduced onto said condenser roller.

26. The apparatus according to claim 25, wherein said condenser roller is provided with dual-function teeth.

27. The apparatus according to claim 6, having means for tilting a side surface of said fiber stream separator body relative to at least one of said at least three rollers, for decreasing the distance between one edge of said body and said roller, and increasing the distance between the opposite edge of said body and said roller.

28. The apparatus according to claim 6, wherein the distance between an edge of a side surface of said fiber stream separator body and a roller adjacent thereto, and the distance between an opposite edge of said fiber stream separator body and said same roller, are unequal.

* * * * *